US007793810B2

(12) United States Patent
DeVries

(10) Patent No.: US 7,793,810 B2
(45) Date of Patent: Sep. 14, 2010

(54) APPARATUS AND METHODOLOGY FOR DE-SHEATHING COVERED DRINKING STRAWS

(76) Inventor: John T. DeVries, 150 Ridge St., P.O. Box 336, Virginia City, NV (US) 89440

( * ) Notice: Subject to any disclaimer, the term of this patent is extended or adjusted under 35 U.S.C. 154(b) by 248 days.

(21) Appl. No.: 12/104,431

(22) Filed: Apr. 16, 2008

(65) Prior Publication Data

US 2008/0256804 A1 Oct. 23, 2008

Related U.S. Application Data

(60) Provisional application No. 60/923,671, filed on Apr. 16, 2007.

(51) Int. Cl.
*B65B 61/00* (2006.01)

(52) U.S. Cl. ..... 225/1; 225/52; 221/63

(58) Field of Classification Search ..... 225/1, 225/52; 221/63; 426/85; 239/16–33; 81/9.4–9.44
See application file for complete search history.

(56) References Cited

U.S. PATENT DOCUMENTS 647,195 A 4/1900 McCutchen et al.
2,004,614 A * 6/1935 Meagher ..... 206/63.5
3,246,814 A * 4/1966 Lovell et al. ..... 225/1
4,017,002 A * 4/1977 Doyle et al. ..... 221/63
4,631,059 A 12/1986 Wolvek et al.
5,054,264 A * 10/1991 Miller ..... 53/412
5,201,254 A * 4/1993 Davies ..... 81/9.42
5,636,560 A * 6/1997 Paul ..... 83/861
2005/0035136 A1* 2/2005 Dathe et al. ..... 221/71

* cited by examiner

*Primary Examiner*—Boyer D. Ashley
*Assistant Examiner*—Edward Landrum
(74) *Attorney, Agent, or Firm*—Long & Chybik

(57) ABSTRACT

One possible embodiment of the invention could be a de-sheathing apparatus and a methodology of its use in de-sheathing a covered drinking straw. The de-sheathing apparatus could comprise of a body having a de-sheathing device, the de-sheathing device forming a de-sheathing orifice into which a covered drinking straw may be inserted, wherein the de-sheathing device applies sufficient force to the covered drinking straw to prevent passage of at least a portion of the covering back through the de-sheathing orifice when the drinking straw with the remainder of covering is removed from proximity with the de-sheathing apparatus.

12 Claims, 19 Drawing Sheets

APPARATUS AND METHODOLOGY FOR DE-SHEATHING COVERED DRINKING STRAWS

CROSS-REFERENCES TO RELATED APPLICATIONS

This application claims the benefit under 35 U.S.C. §119 (e) of U.S. Provisional Patent Application No. 60/923,671, filed on Apr. 16, 2007, contents of which are relied upon and incorporated by reference.

STATEMENT REGARDING FEDERALLY SPONSORED RESEARCH OR DEVELOPMENT

Not Applicable.

REFERENCE TO A "MICROFICHE APPENDIX"

Not Applicable.

FIELD OF THE INVENTION

The present invention generally relates to de-sheathing apparatus and methods of use for the same. More particularly, the present invention generally relates to apparatus and methods for partially de-sheathing covered drinking straws.

BACKGROUND

In today's world of fast food service, many people wish to have their food served quickly and enjoy it without waiting long periods, thus allowing them to conserve their time for the pursuit other pleasures and diversions. As such, various food establishments have implemented many time saving features such as production assembly of foodstuffs, use of cooking methodologies to speed preparation of food, use of containers for ease of transporting foodstuffs by the consumer, and the like. Any device that could save labor or time in these circumstances could be considered a valued commodity.

One area that needs improvement is in regards to covered drinking straws. Covered drinking straws (e.g., a drinking straw that is generally enclosed within a plastic, paper, or the like, covering or sheath) may often be distributed by the restaurant industry to their patrons as a sanitary measure and convenience. The patron or consumer then generally removes the covering (e.g., de-sheathes the covered drinking straw) to substantially obtain and use a generally clean and sanitary drinking straw for the consumption of their beverage.

One possible covered drinking straw de-sheathing method requires the patron or consumer to grasp the cover of a covered drinking straw and to lightly press one end of the covered drinking straw down upon a solid object (e.g., a dining table; the consumer's knee or thigh). The consumer could then try to continue to press at least a portion of the cover towards the pressed end of the drinking straw. Normally, this action could cause the other end of the straw to generally break through and protrude out the other end of the cover. With the seal of the cover broken as such, the consumer could easily discard the cover by holding the open end of the straw in the consumer's mouth and pulling off the sheath (e.g., remaining) with one hand. However many younger consumers have been known to blow into the straw to launch the remaining sheath as an air-borne projectile much to the annoyance and consternation of older consumers. In addition to annoyance, the eventual landing of such a projectile may convert the landed item into litter and contribute to the clean-up needs of the fast food enterprise providing the straw.

To further aid in the ease of de-sheathing drinking straws, other attempts have generally employed making a section of the drinking straw cover weaker (e.g., more susceptible to tearing action) than the remaining portion of the cover (e.g., through the use of perforations.) In this manner, the user may find it easier to tear off a portion of the cover aligned with this section thus allowing for easier removal of the cover from the drinking straw. A consumer could hold such a covered drinking straw in one hand (e.g., the forefinger and thumb grasping the portion proximate to the weaker section) and pulling it away from the section generally held by the other fingers in the hand. In this manner, the weaker section may be torn away from the stronger section of the drinking straw covering, thus unmasking an end portion of the drinking straw. This solution still could be considered a clumsy method of de-sheathing a covered drinking straw and may not be easily practiced by one who is not that dexterous.

What is needed therefore is an apparatus that can generally allow a simple, one-handed, quick motion by an individual to partially de-sheath a cover from a covered drinking straw in a sanitary and efficient manner.

SUMMARY OF ONE EMBODIMENT OF THE INVENTION

Advantages of One or More Embodiments of the Present Invention

The various embodiments of the present invention may, but do not necessarily, achieve one or more of the following advantages:

the ability to de-sheath, at least partially, a covered drinking straw using a single handed motion;

to provide a sanitary method for generally removing at least a portion of a cover from a drinking straw;

the ability to de-sheath, at least partially, a covered drinking straw in a manner that could reduce the amount of litter that can accompany such a process; and to provide an apparatus that can partially de-sheath a covered drinking straw, the apparatus being substantially simple, easily manufactured, and which may be employed in a wide variety of environs.

These and other advantages may be realized by reference to the remaining portions of the specification, claims, and abstract.

BRIEF DESCRIPTION OF ONE EMBODIMENT OF THE PRESENT INVENTION

One possible embodiment of the invention could be a de-sheathing apparatus for a covered drinking straw comprising a body having a de-sheathing device; the de-sheathing device forming a de-sheathing orifice into which a covered drinking straw may be inserted, wherein the de-sheathing device applies sufficient force to the covered drinking straw to generally prevent passage of at least a portion of the covering of the covered drinking straw back through the de-sheathing orifice when the drinking straw with the remainder of covering is removed from contact with the de-sheathing device.

Another version of the invention could be a method for operating a de-sheathing device for a covered drinking straw comprises of steps of providing a body having a de-sheathing device that forms a de-sheathing orifice into which can be inserted a covered drinking straw; inserting a covered drinking straw into the de-sheathing orifice in one direction; applying force by the body to the covered drinking straw; moving the covered drinking straw in a second direction; and preventing a portion of a covering from the covered drinking straw from passing back through the de-sheathing orifice.

The above-description sets forth, rather broadly, a summary of one embodiment of the present invention so that the detailed description that follows may be better understood and contributions of the present invention to the art may be better appreciated. Some of the embodiments of the present invention may not include all of the features or characteristics listed in the above summary. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. In addition, it is to be understood that the phraseology and terminology employed herein are for the purpose of description and should not be regarded as limiting.

DESCRIPTION OF CERTAIN EMBODIMENTS OF THE PRESENT INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention.

Figure 1:
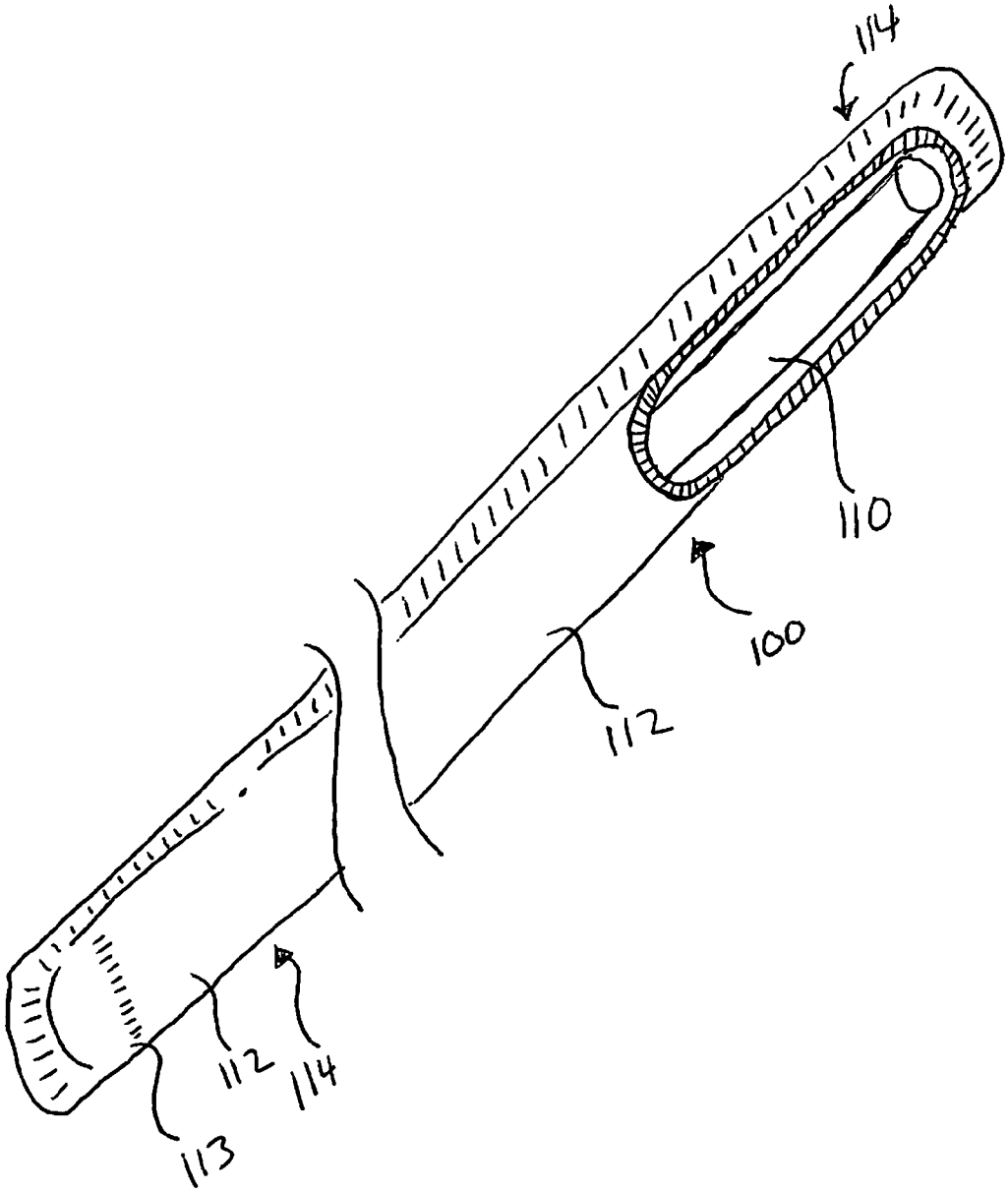
FIG. 1 is substantially a perspective view of a covered drinking straw.

As shown in FIG. 1, a covered drinking straw 100 may be comprised of a drinking straw 110 (e.g., a flexible, hollow tube with two open ends) that is generally encapsulated within a sheath or covering 112. The covering 112 may be made from a folded paper or other suitable material that may have one or more of its edges sealed together. In other instances, the covering 112 may be a tube of a diameter generally larger than that of the enclosed drinking straw 110, the covering 112 be sealed by having enclosed end portions 114. In some versions of the covering 112, the sealed edges or end portions 114 may have perforations 113 to assist in the opening of the covering 112 by the consumer or other drinking straw user.

The invention 1 could comprise both a de-sheathing, apparatus 10 for the covered drinking straw 100 and a methodology or process 200 for employing a de-sheathing apparatus 10 to at least partially de-sheath a covered drinking straw 100. As substantially shown in FIGS. 2-5C, the de-sheathing apparatus 10 could comprise a body 12, which could at least define, incorporate, or further comprise a de-sheathing device 14 that could correspondingly further define, form, or denote a de-sheathing orifice 16. In at least one embodiment, the body 12 could further comprise or define a top side 18 and a bottom side 20. The bottom side 20 could generally define an under side 22 while the top side 18 could generally define an upper side 24.

The body 12 could be made of a wide variety of materials and a wide variety of patterns known in the art. In at least one embodiment, at least the portion of the body 12 defining the de-sheathing device 14 could be made from suitable elastic materials, whose elastic properties could then generally be imparted to the de-sheathing device 14.

One possible embodiment of the de-sheathing device 14 could generally be comprised of a plurality of fingers 120, each finger 120 having a base 122 and a movable tip 124. The plurality of fingers 120 could be radially disposed in the same plane and around a central axis 125 with the bases 122 being generally connected to or otherwise attached to the body 12. The radial arrangement of the plurality of fingers 120 could provide that a circumference of the bases 122 (not shown) could generally be larger than a circumference (not shown) of the movable tips 124. The subsequent orientation of the movable tips 124 thus may generally form the de-sheathing orifice 16.

The movable tips 124 may have two positions, a first position 128 and a second position 130. The movable tips 124 may be in the first position 128, which has a first de-sheathing orifice diameter 126, when there is no covered drinking straw 100 inserted in the de-sheathing orifice 16. The movable tips 124 then may move to a second position 130, having a second de-sheathing orifice diameter 127 that is larger than the first de-sheathing orifice diameter 126, when the covered drinking straw 110 is inserted in the de-sheathing orifice 16.

Figure 2:
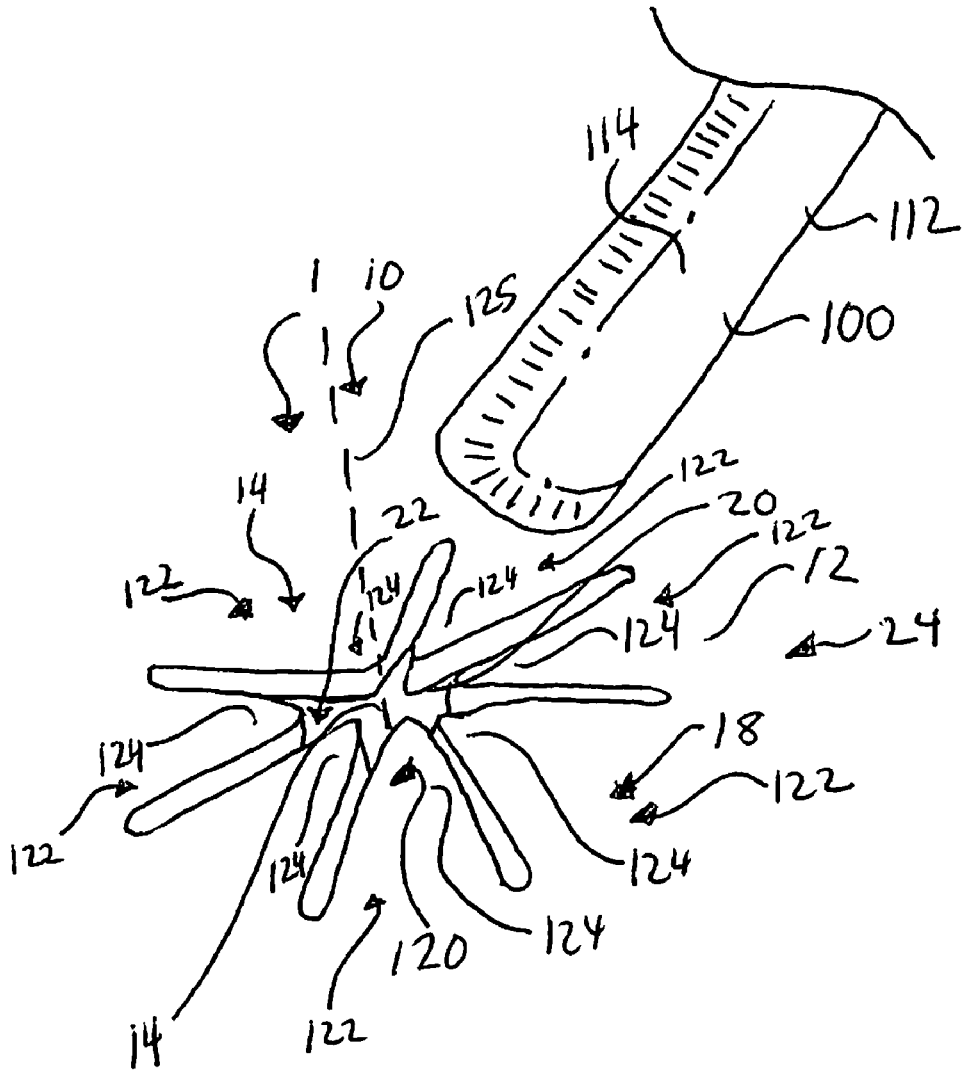
FIG. 2 is substantially a perspective view of one embodiment of the present invention.
Figure 2A:
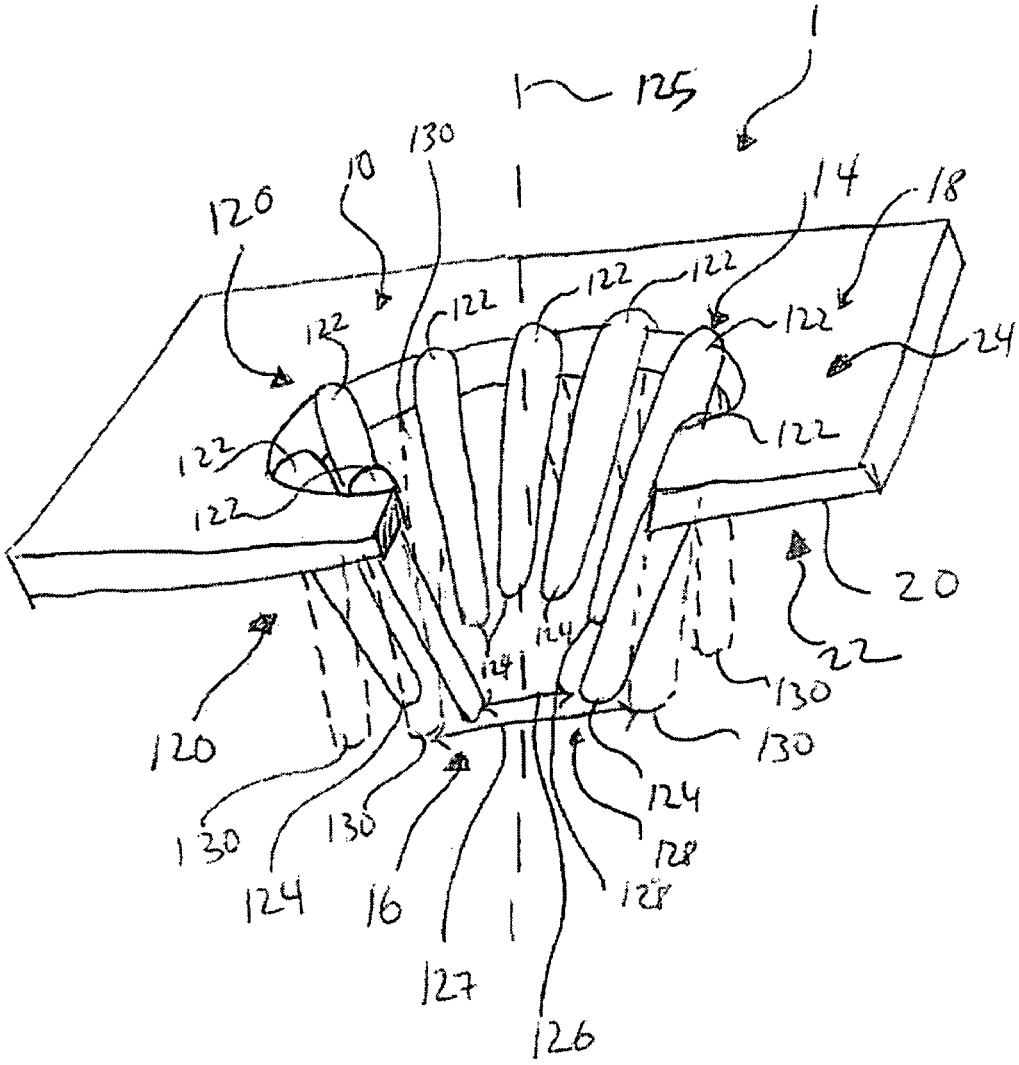
FIG. 2A is substantially a perspective view of a spiral embodiment of the present invention.
Figure 2B:
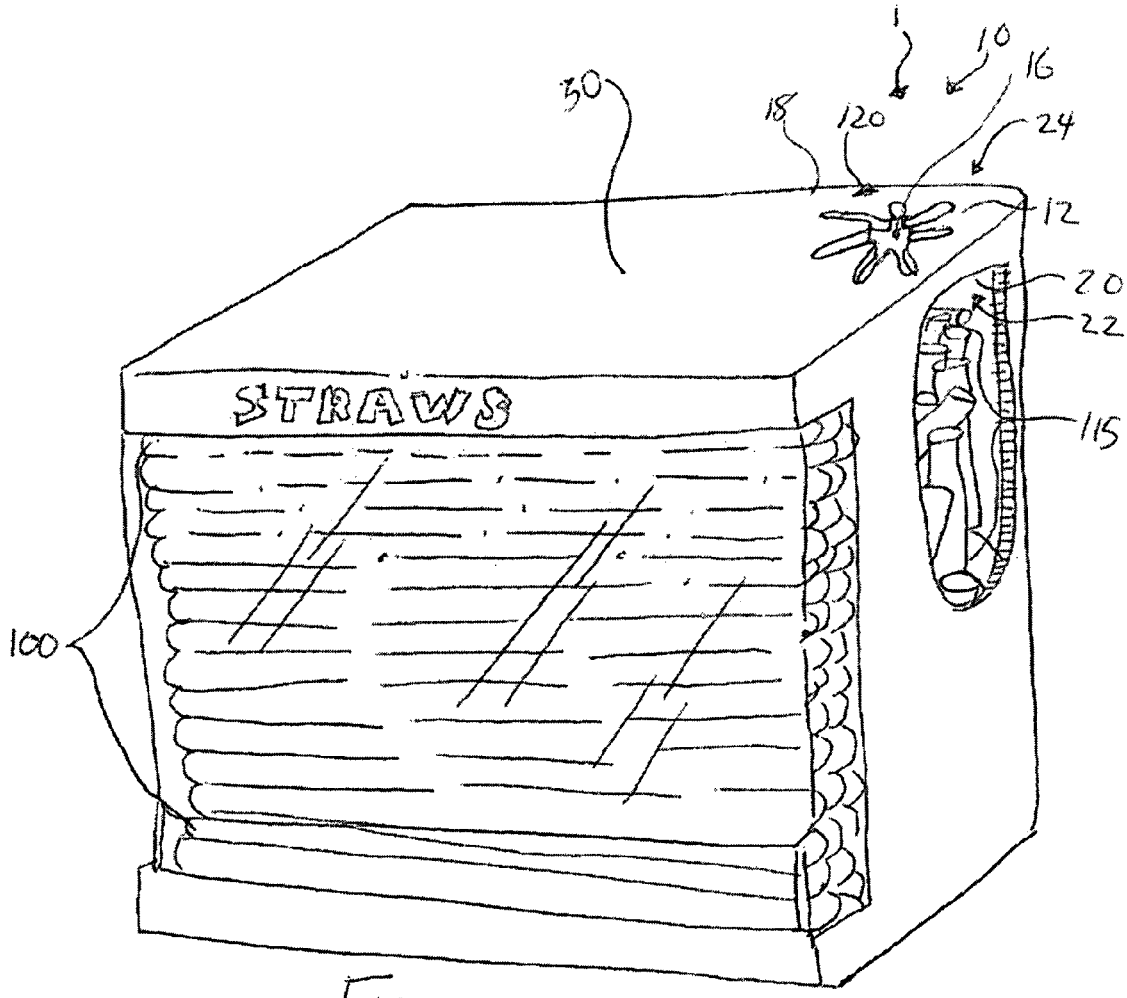
FIG. 2B is substantially a perspective cutaway view of a straw dispenser embodiment of the present invention.
Figure 2C:
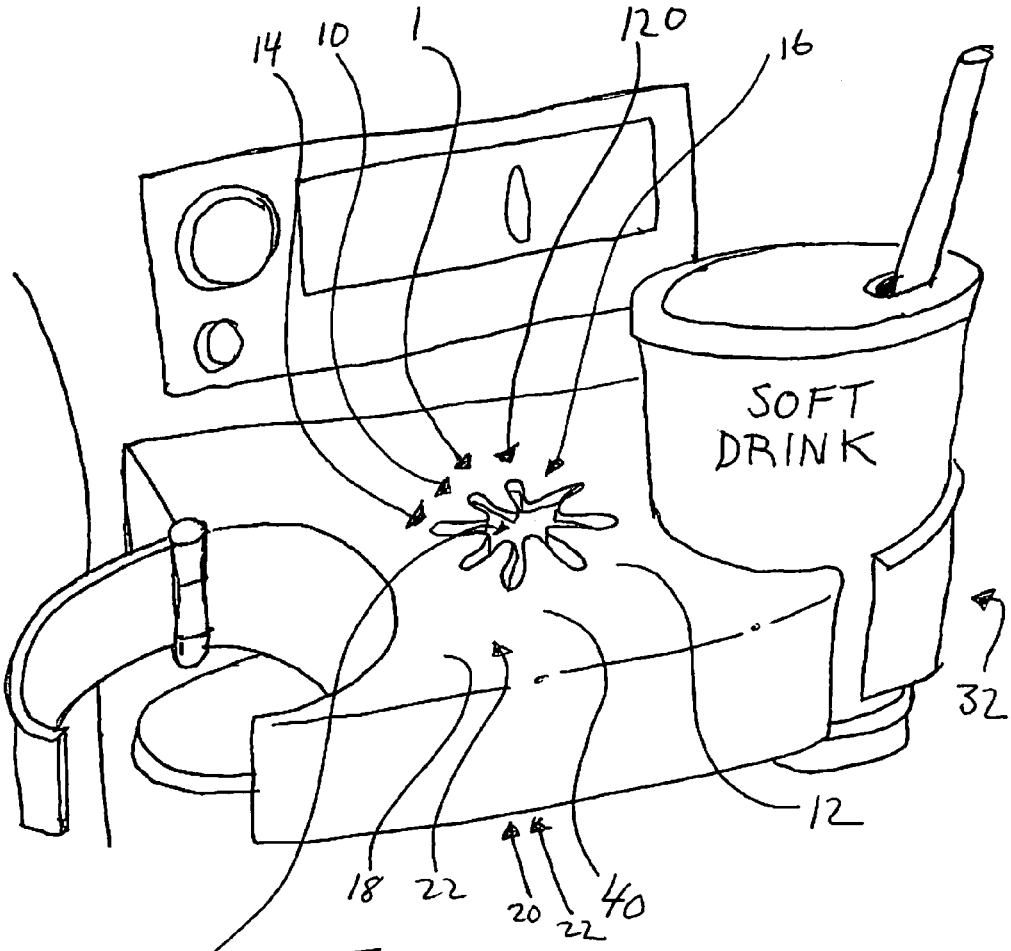
FIG. 2C is substantially a perspective view of a cup holder embodiment of the present invention.
Figure 2D:
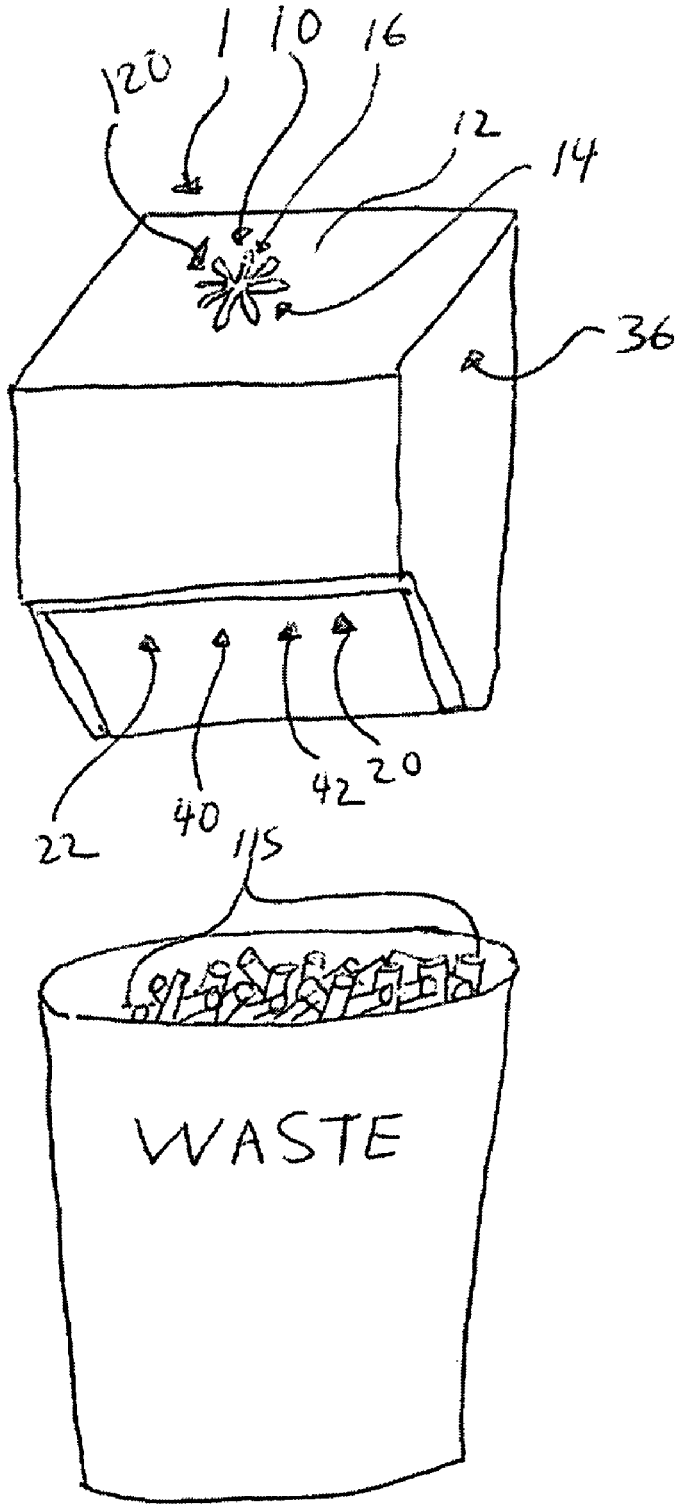
FIG. 2D is substantially a perspective view of a wall-mounted embodiment of the present invention.
Figure 2E:
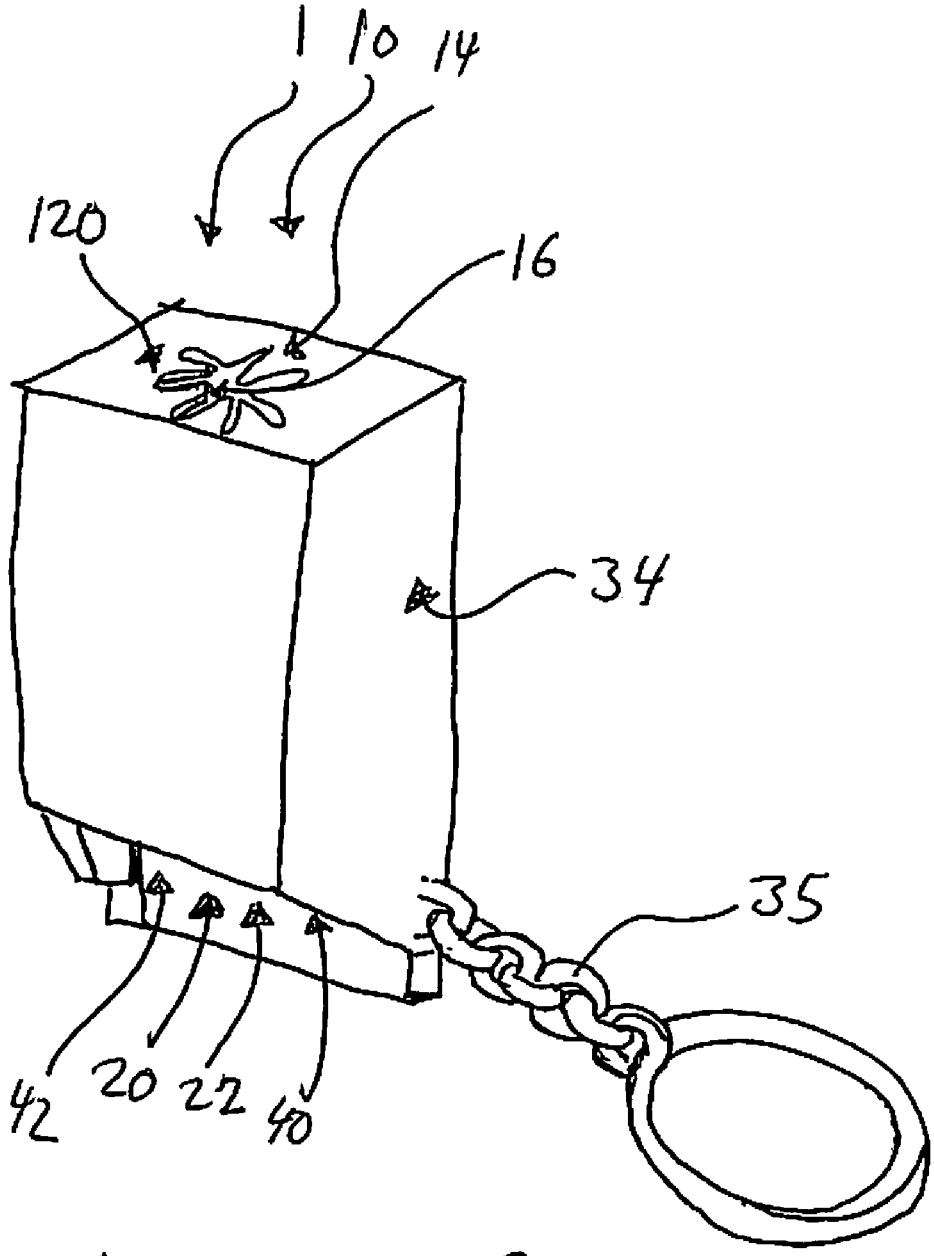
FIG. 2E is substantially a perspective view of a stand-alone pocket embodiment of the present invention.

The overall de-sheathing device's 14 type, size, and materials (as well as the configuration and construction of the plurality of fingers 120) could vary depending upon the various needs placed upon a particular embodiment of the invention 1. These parameters could be selected and adjusted by those who are skilled in the art. In one version, substantially shown in FIG. 2, the plurality of fingers 120 could be elastic, one piece construction, and radially disposed in generally the same plane. In FIG. 2A, another version of the invention 1, the plurality of fingers 120 could be generally non-elastic, multiple piece, and relying on the elasticity of the particular construction of the body 12 to which they are attached to generally provide for the movement of the movable tips 124 between the first position 128 and second position 130. In this version, the plurality of fingers 120 could be arranged in a generally inverted conical shape.

As generally shown in FIGS. 2B-2E, the body 12 (and the de-sheathing device 14 that it contains) may be incorporated into a wide variety of objects. These objects could include, but not necessarily be limited to, a drinking straw dispenser 30, a cup-holder for a car 32, a stand-alone pocket device 34 (e.g., an attachment to a key-chain 35), a wall-mounted device 36, and the like. The body 12, in at least one embodiment, could further generally define a compartment 40 (either generally enclosed or otherwise having a secondary non de-sheathing orifice opening), the compartment 40 generally defining a substantially hollow interior 42. The hollow interior 42, in at least one embodiment, could receive and hold, at least temporarily, a portion of the covering 115 as removed from the covered drinking straw 100 by the de-sheathing device 14.

Figure 3:
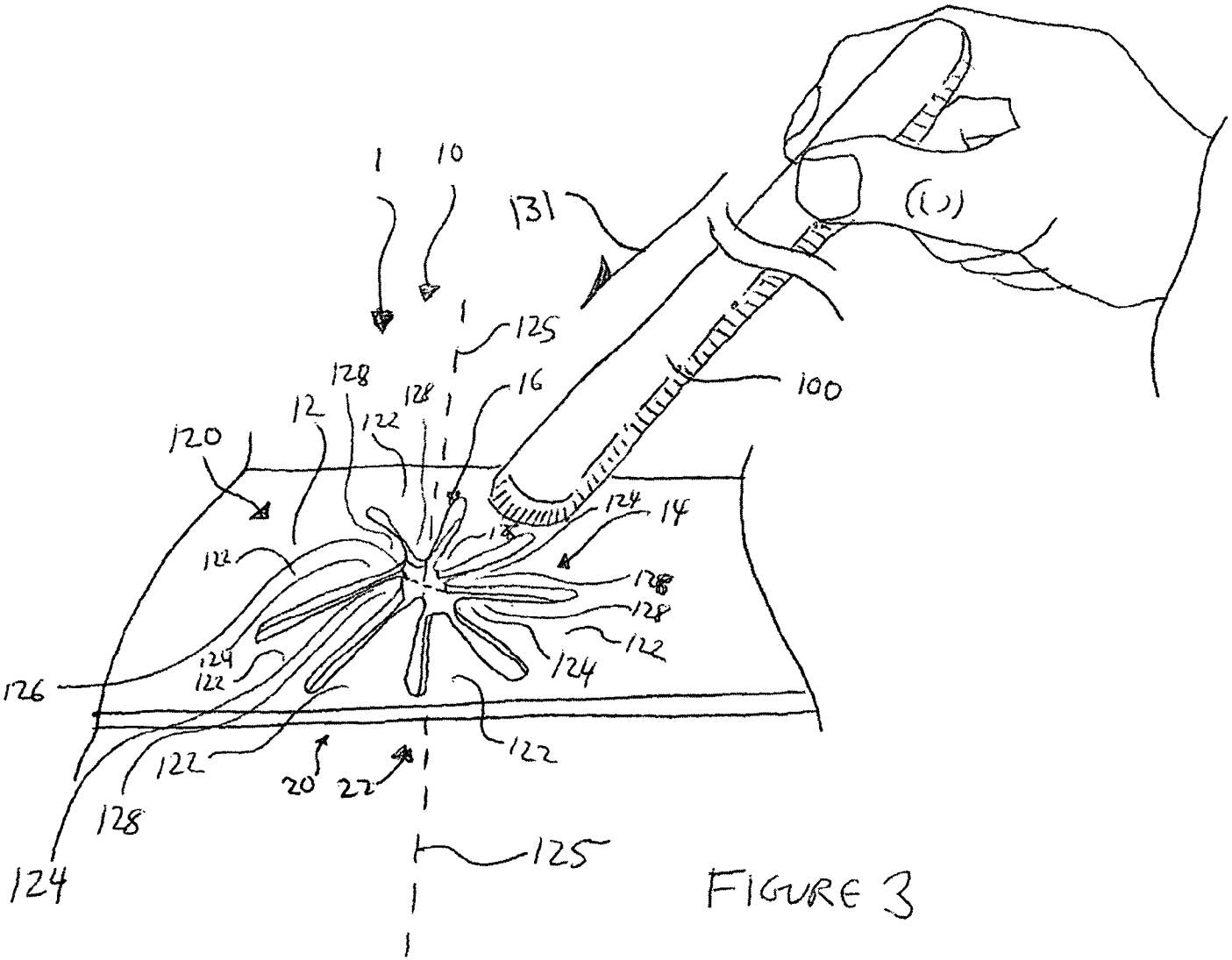
FIGS. 3-3E are substantially a series of perspective views of a covered drinking straw being de-sheathed utilizing one embodiment of the present invention.
Figure 3A:
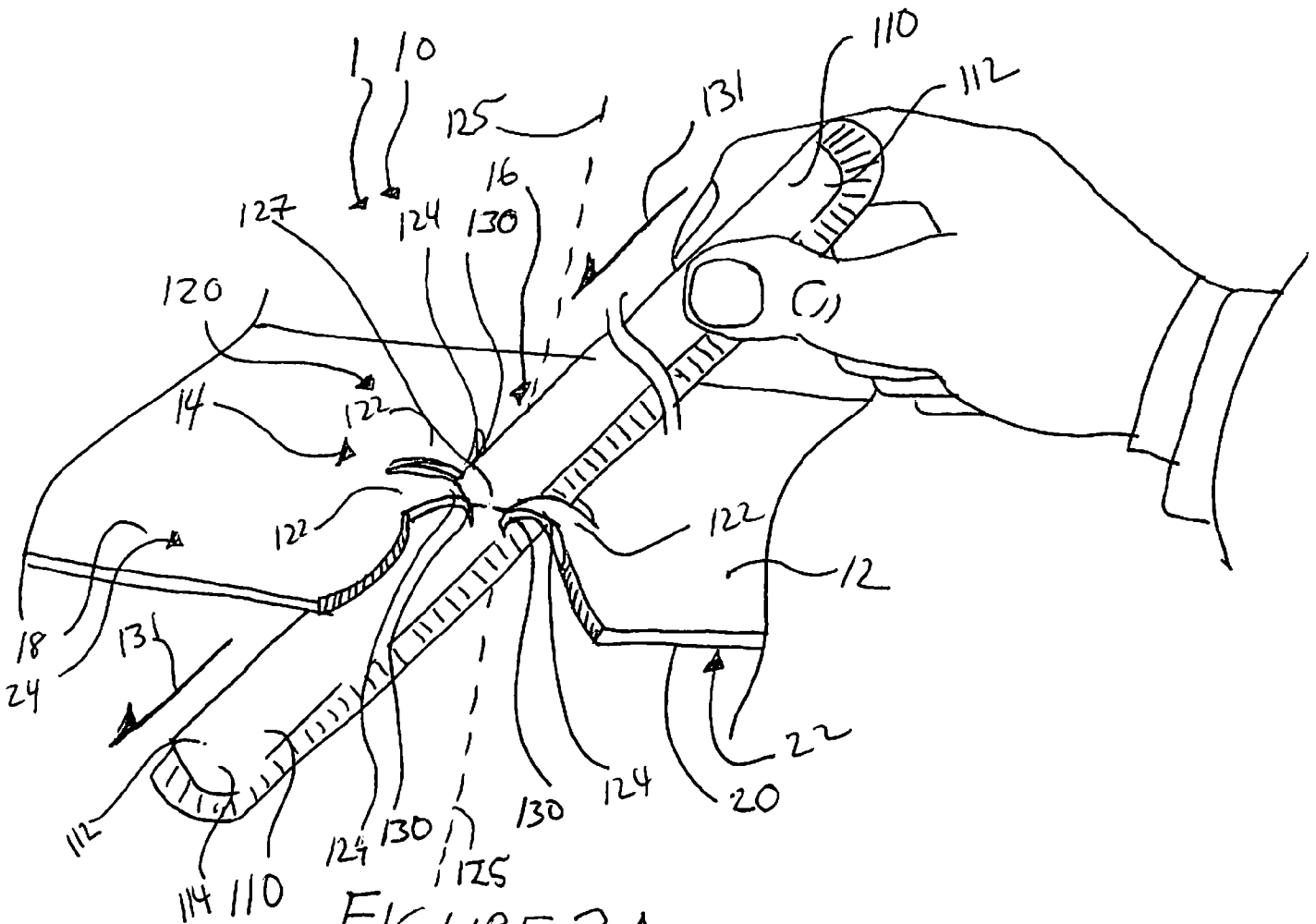
Figure 3B:
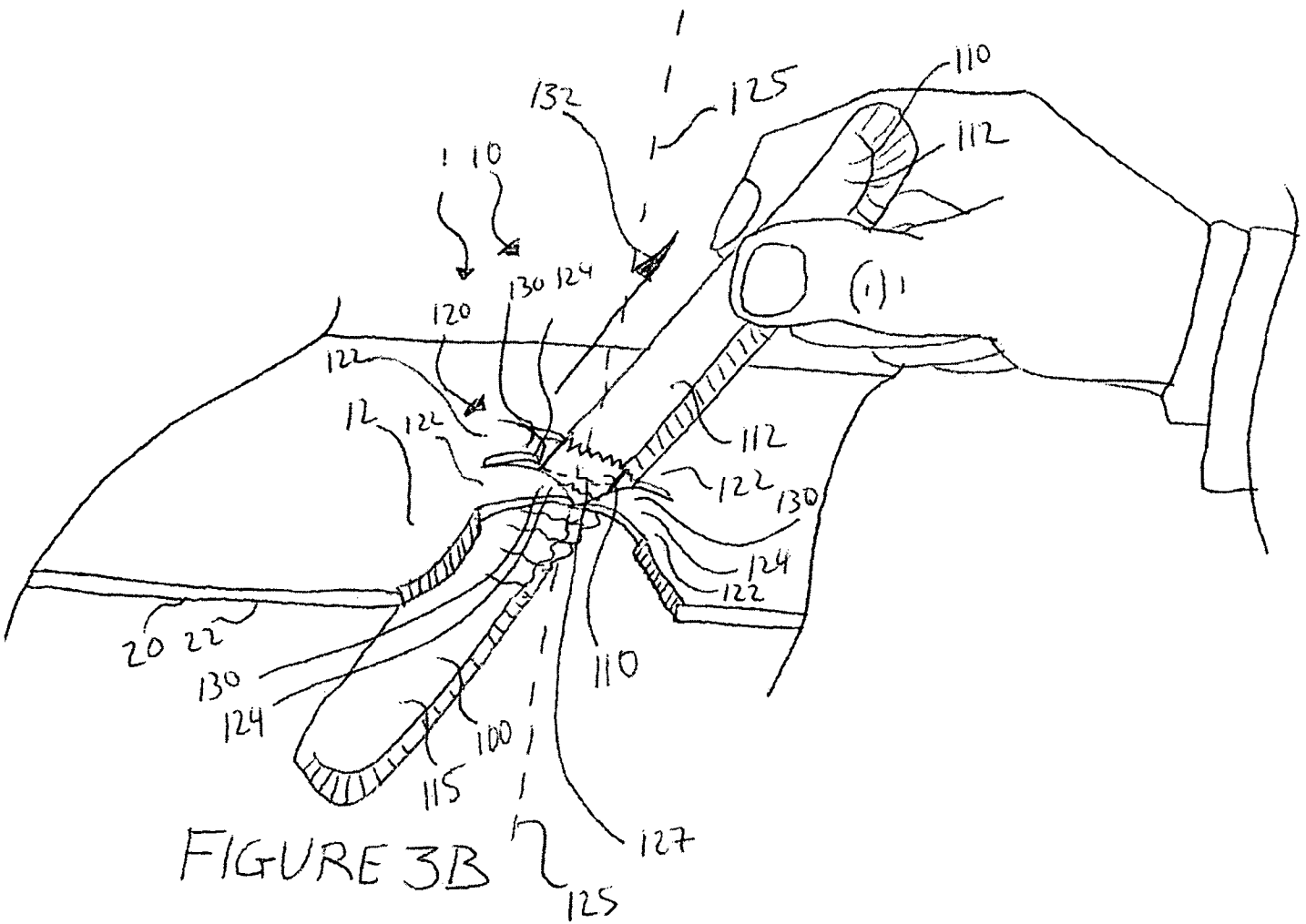
Figure 3C:
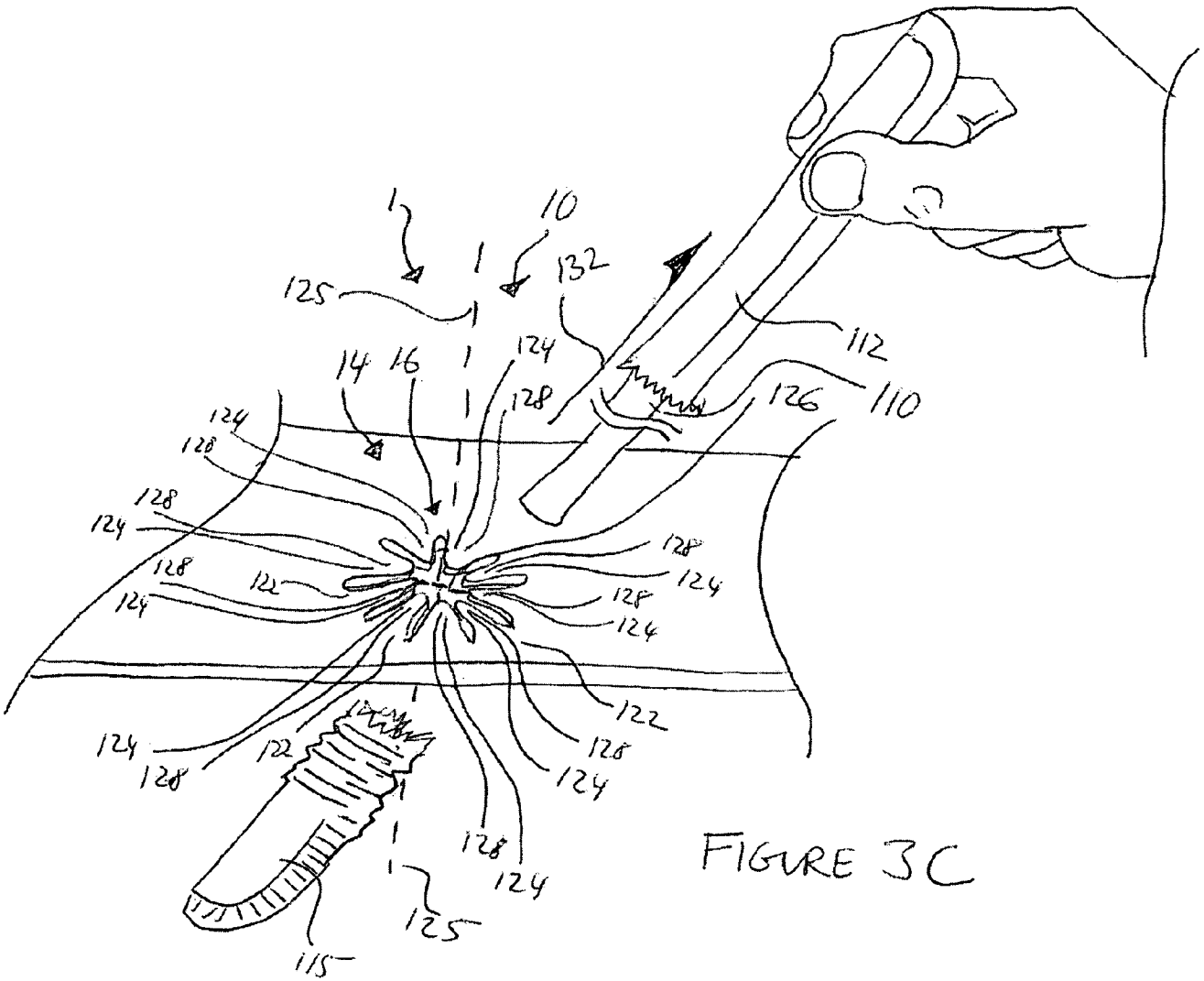
Figure 3D:
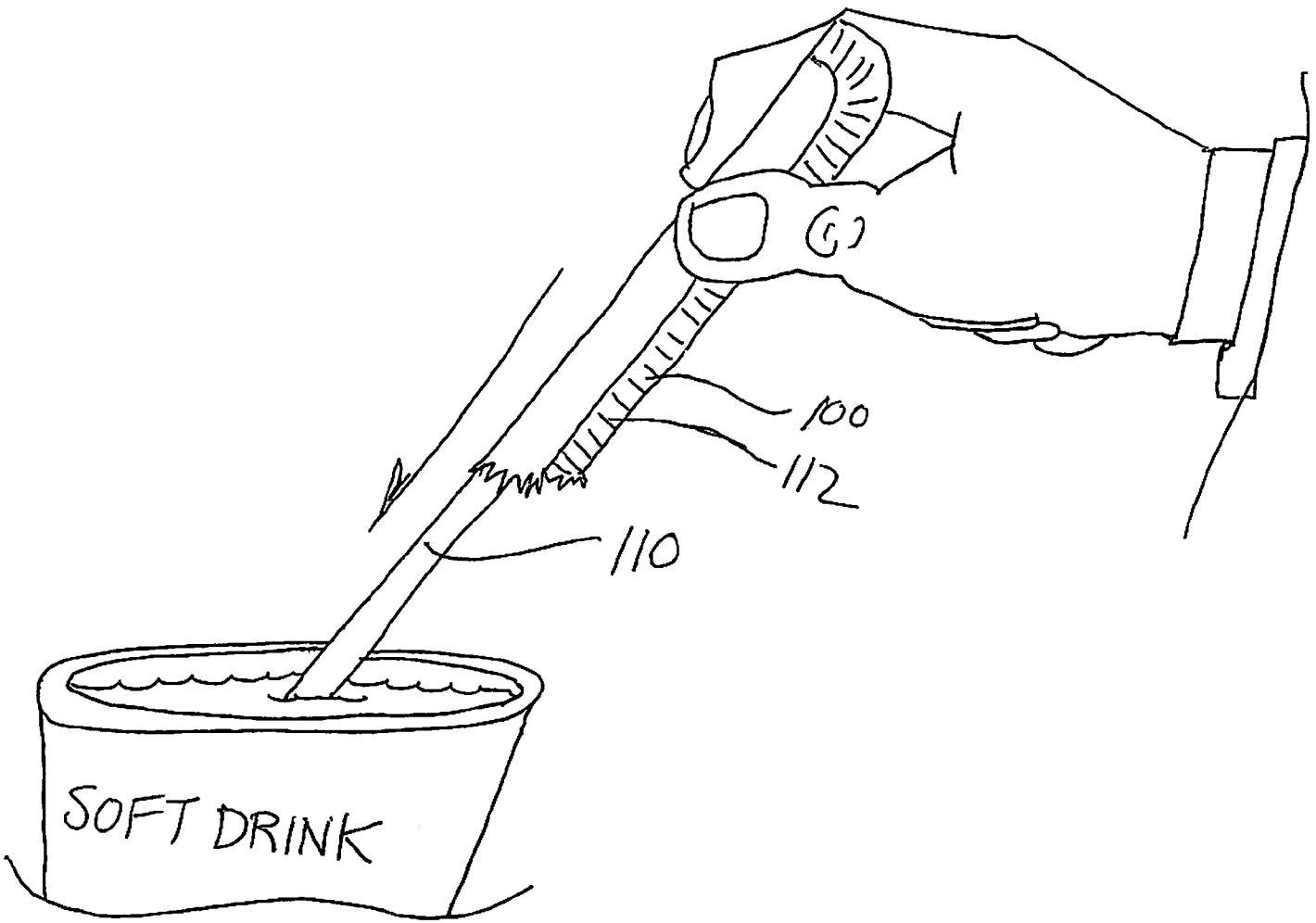
Figure 3E:
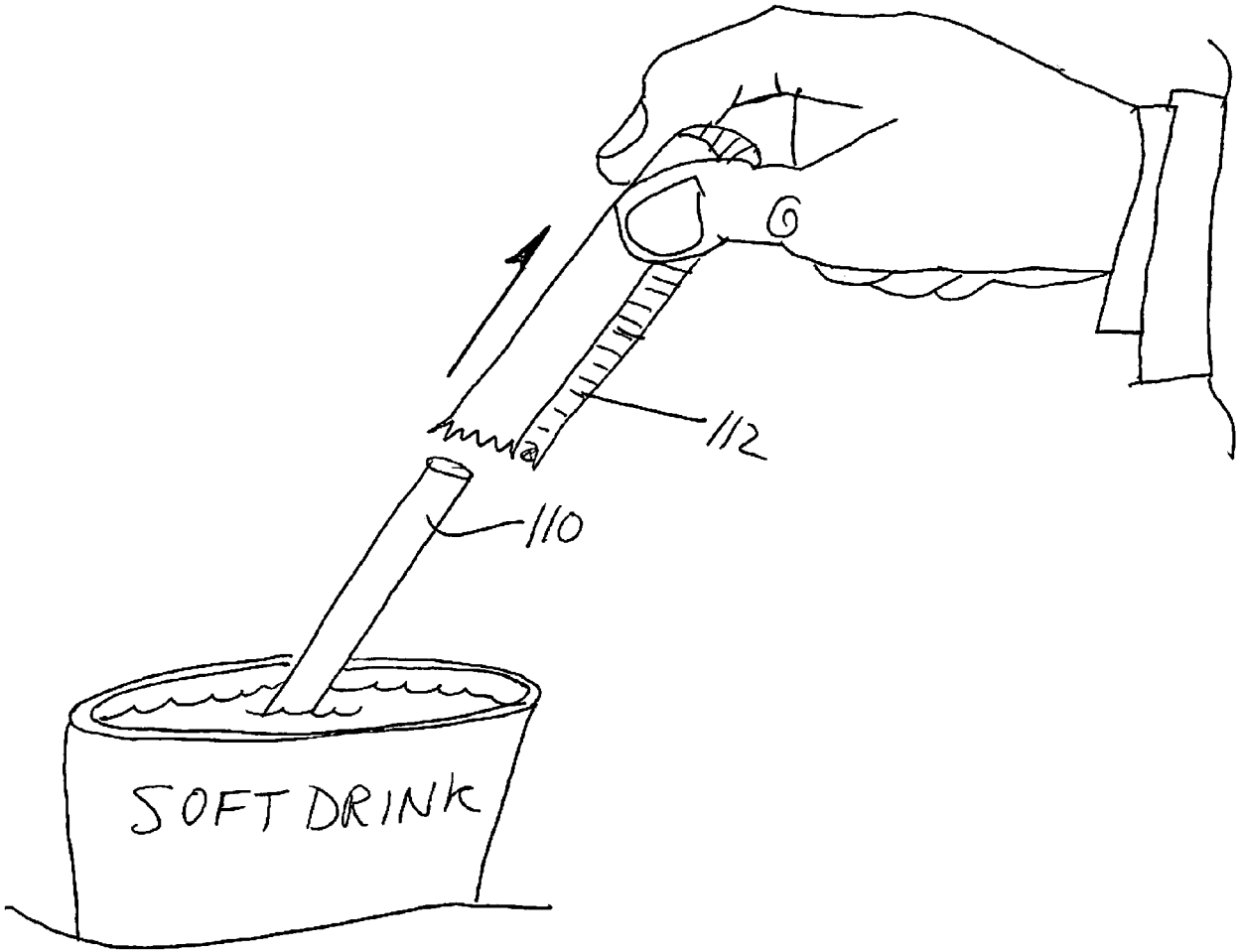

As shown substantially in FIGS. 3-3E, during operation of the invention, the action of the placement or insertion of the covered drinking straw 100 into the de-sheathing orifice 16 in a first direction 131 could be enough to move the movable tips 124 from a first position 128, where the movable tips 124 form a de-sheathing orifice 16 of the first orifice diameter, to a second position 130, where the movable tips form a de-sheathing orifice 16 of the second and larger orifice diameter 127. In going into the second position 130, the plurality of fingers 120 could impose enough force upon the covered drinking straw 100 that would allow the passage through the de-sheathing orifice 14 (having the second or larger orifice diameter 127) in the first . . . .

During operation, as an end portion 114 of the covered drinking straw 100 is substantially pressed into the de-sheathing device 14, the force of the covered drinking straw 100 coming into contact the fingers 120 could bend at least bend one or more movable tips 124 generally towards the under side 22 of the body 20 (e.g., from a first position 128 to a second position 130.) This movement of the movable tips 124 could generally allow the size of the de-sheathing orifice 16 to be increased, generally affording passage towards the proximity of the under side 22 of at least a part of the covered drinking straw 100. As such, the de-sheathing device 14 should be constructed (in a manner known to those skilled in the art) so that de-sheathing orifice 16 should be of initial sufficient size (and the fingers 120 of appropriate size and movable tips 124 having sufficient movement) to allow the end portion 114 of the covered drinking straw 100 to pass by the movable tips 124 in the second position 130, without one or more movable tips, 124 causing a portion of the covering 112 to tear during this portion of the operation.

An operator then stops pushing the covered drinking straw 100 into the de-sheathing apparatus 10 (e.g., into the de-sheathing orifice 14) and begins to draw away (in the second or opposite direction 132) at least a portion of the covered drinking straw 100 from the de-sheathing device 14, then one or more of the tips 124 could firmly be pressed against the covering 112. This overall action may generally cause the severance of the portion of the covering 112 from the remainder of the now partially de-sheathed covered drinking straw 110 as the straw 110 (and remaining covering 112) is moved out and away from the de-sheathing device 14.

To remove the remainder of the covering 112 left on the partially de-sheathed covered drinking straw 100 after its withdrawal from the invention 1, the operator could place the uncovered portion of the drinking straw 110 into a desired drink. The operator, by gingerly grasping the remainder of the covering 112, could then lift off the remainder of the covering 112 from the drinking straw 110, leaving the now fully de-sheathed drinking straw 110 in contact with the desired drink. The remainder of the covering 112 could then be properly disposed of by the operator.

Figure 4:
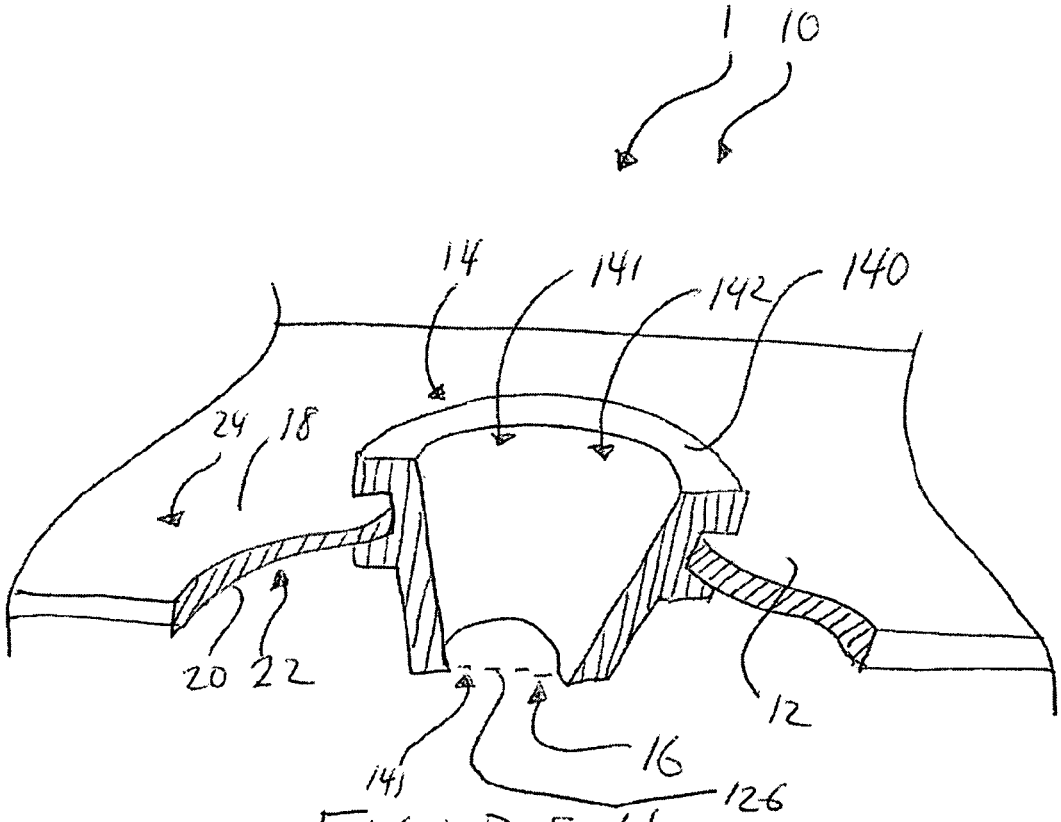
FIG. 4 is substantially a perspective cutaway view of another embodiment of the invention.
Figure 5:
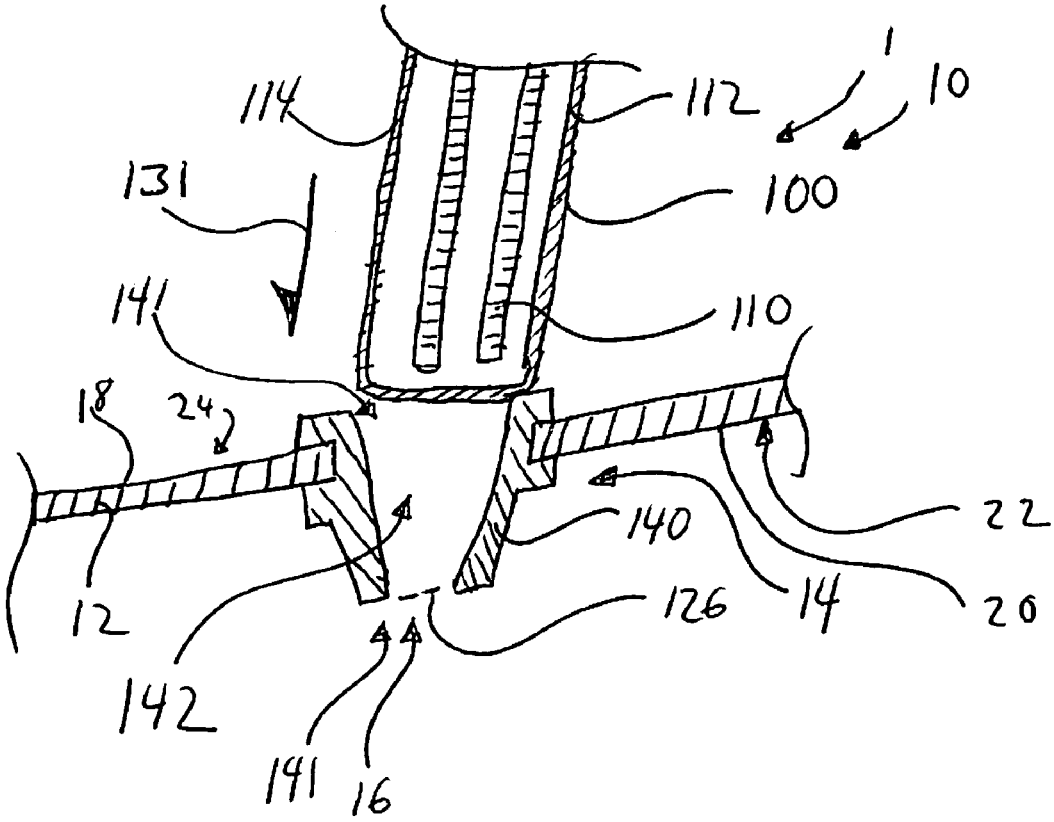
FIGS. 5-5C are substantially cutaway elevation views of the invention.
Figure 5A:
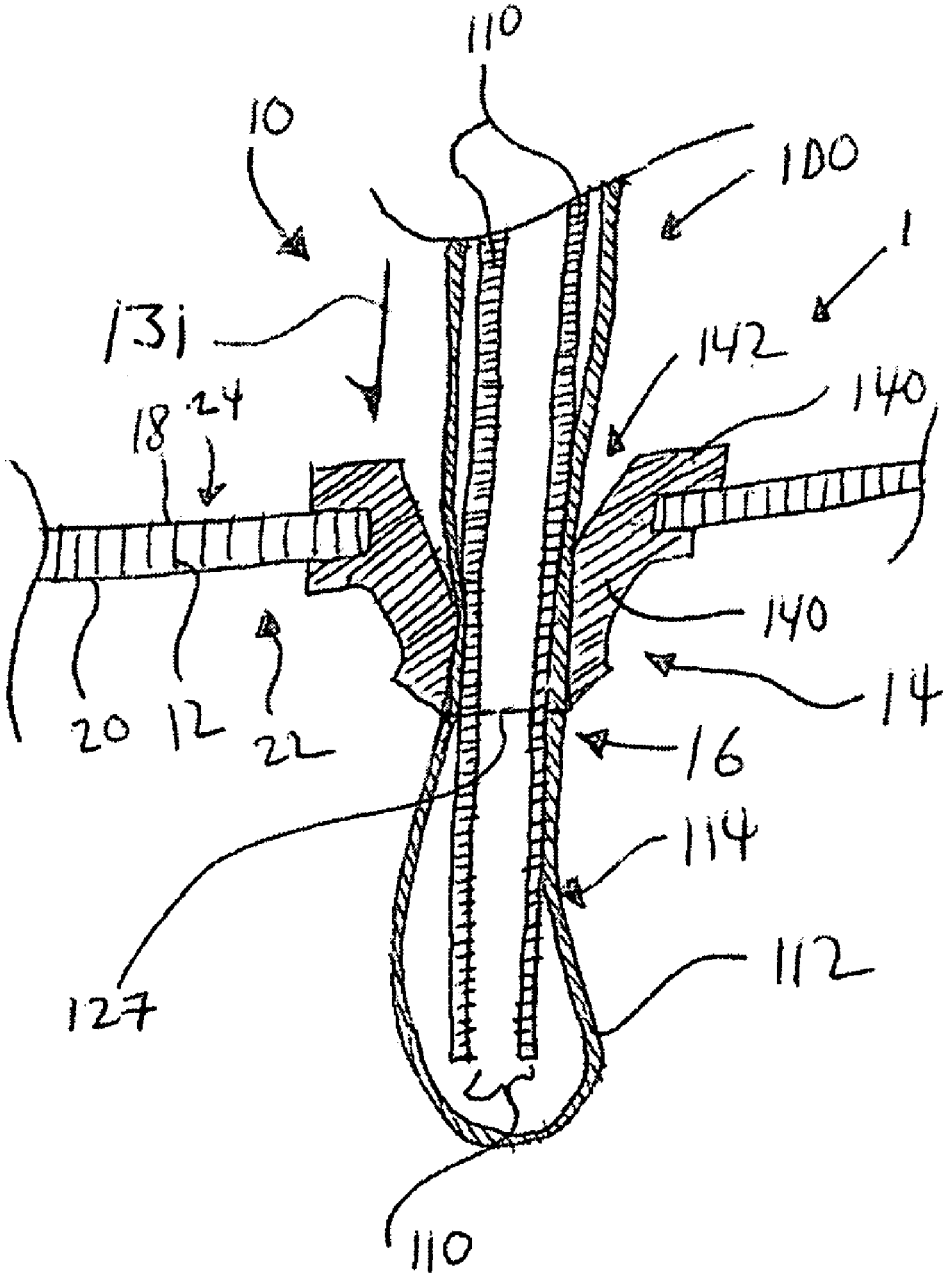
Figure 5B:
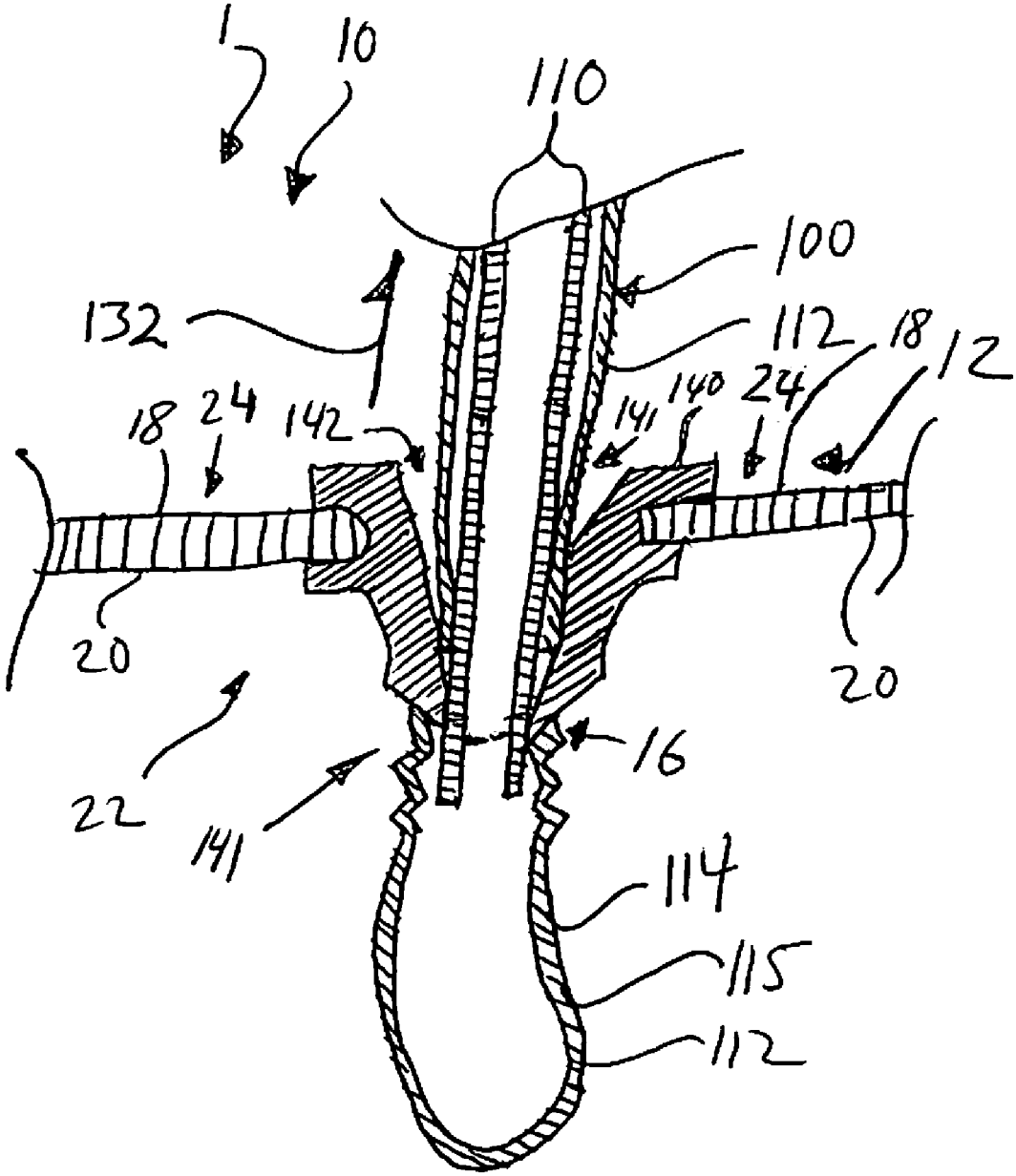
Figure 5C:
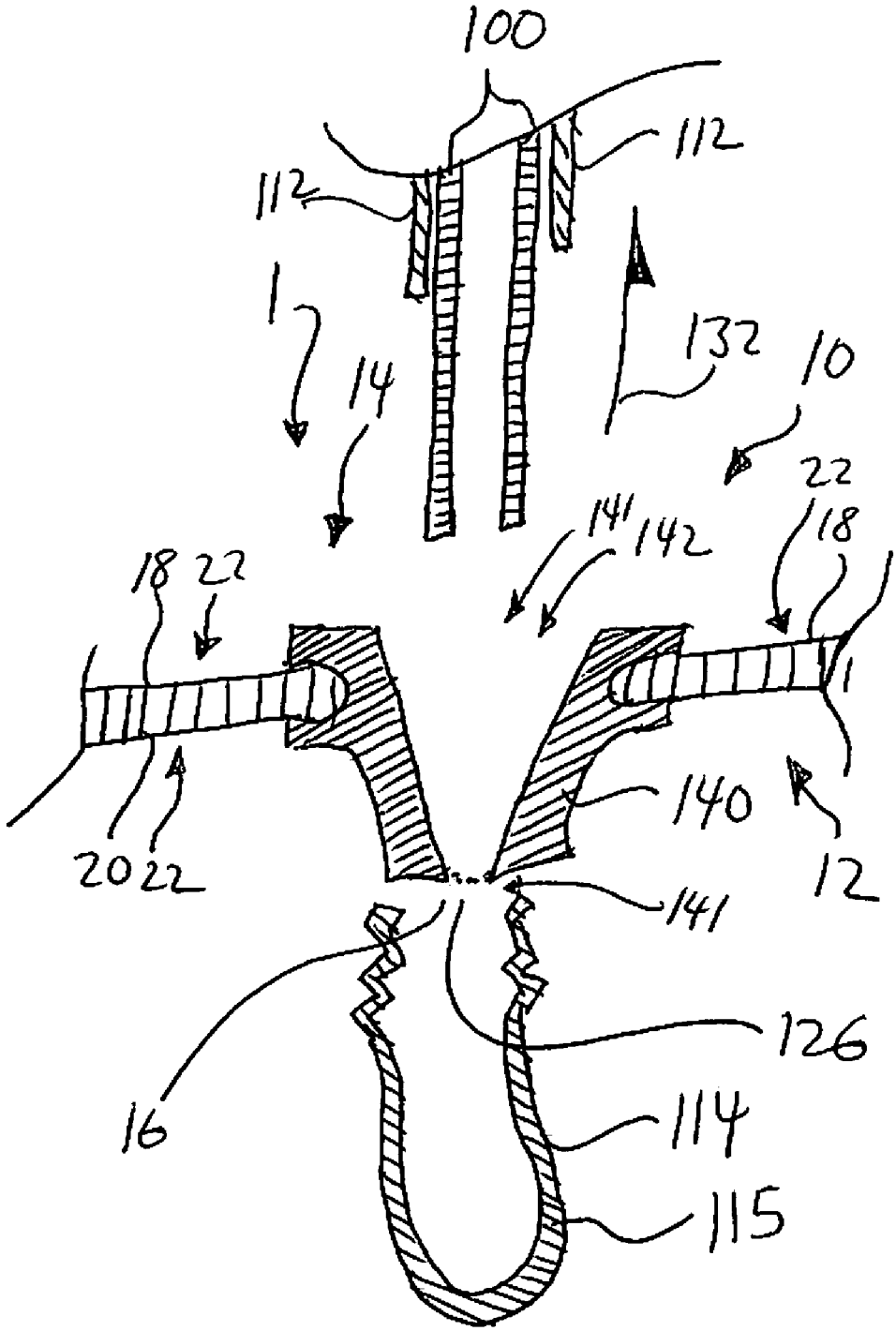

As substantially shown in FIG. 4, another embodiment of the invention could have the de-sheathing device 14 be an elastic tube 140 with open ends 141 being connected by a hollow tube interior 142 (e.g., the tube could be made from an elastic polymer). The hollow tube interior 142 could form the de-sheathing orifice 16 so that when the elastic tube 140 does not have the covered drinking straw 100 in it, the hollow tube interior 142 could form the de-sheathing orifice having the initial orifice diameter 126. The elastic tube 140 could be so constructed that when the covered drinking straw 100 is moved in the first direction 131 and contacts the elastic tube 140, that elastic tube 140 along with its hollow tube 142 interior can be expanded so that the de-sheathing orifice 16 will be increased to have a larger second orifice diameter 127. The movement of the covered drinking straw 100 subsequently though the de-sheathing orifice 16 in the first direction 131 though could cause the elastic tube 140 to impart a force upon the covered drinking straw 100.

The construction, specifications, material, elasticity, and interior dimensions of the elastic tube 140 could be determined by one who has ordinary knowledge in the art. This construction could generally allow the hollow tube interior 142 to have an inverted conical shape.

When the operator then moves the covered drinking straw 100 in the second direction 132 (e.g., generally opposite of the first direction 131) to generally withdraw the covered drinking straw 100 from the de-sheathing device 14, the force exerted by the elastic tube 140 at this point could be sufficient to generally prevent a portion of the covering 112 from again passing through the de-sheathing orifice 16. This action could result in the portion of the covering 112 being detached (e.g., torn) from the remainder of the covering 112 as the remainder of the now partially de-sheathed covered drinking straw 100 is generally removed from contact and proximity of the invention 1. The elastic tube 140, with the partially de-sheathed covered drinking straw 110 removed from it, could cause its hollow tube interior 142 to present the de-sheathing orifice 16 at its first orifice diameter thus generally causing the severed portion of the covering 112 to be generally retained proximate (e.g., at least temporarily) to the underside 22 (e.g., hollow interior 42 of any present compartment 40).

Methodology

Figure 6:
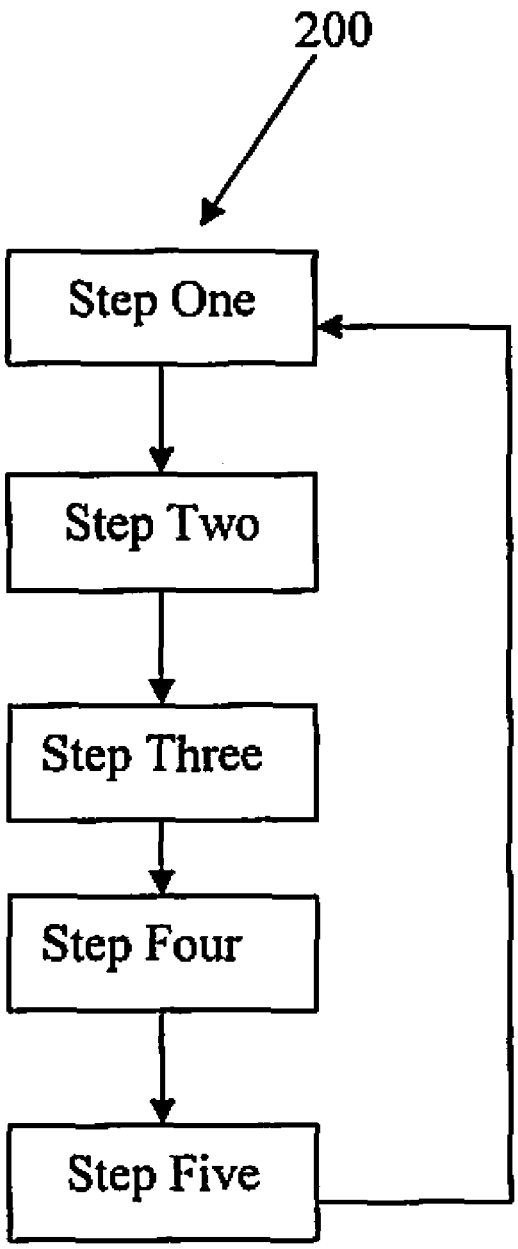
FIG. 6 is substantially a flow chart for one possible embodiment of the process for operating the present invention.

As substantially shown in FIG. 6, another embodiment of the invention could be a process 200 of operating the de-sheathing apparatus starting with step one, orienting the covered drinking straw. In this step, the operator (e.g., consumer, restaurant patron, or the like) could generally place one end of the covered drinking straw to make contact with at least a portion of the de-sheathing orifice. At the substantial completion of step one, the process 200 could substantially proceed onto to step two, engaging the de-sheathing device.

In step two, engaging the de-sheathing device, at least the one end portion of the covered drinking straw generally moves into the de-sheathing device. In one possible embodiment, the covered drinking straw could press in a first direction against the de-sheathing device having a plurality of fingers wherein their movable tips begin generally to move from a first position (forming a de-sheathing orifice of a first orifice diameter) to a second position (forming a de-sheathing orifice of a larger, second orifice diameter). As the covered drinking straw proceeds through the de-sheathing orifice, the tips could ride alongside the cover.

In another possible embodiment, the covered drinking straw could press in a first direction and against at least a portion of the elastic de-sheathing device (e.g., the elastic tube) to begin to stretch the elastic tube and its hollow tube interior from forming a de-sheathing orifice of a first orifice diameter to a de-sheathing orifice of a larger, second orifice diameter. As this deformation or stretching of the elastic tube continues until the hollow tube interior diameter could increase to meet generally the exterior diameter of the covered drinking straw.

As step two substantially is completed, the process 200 could proceed onto step three, stopping the covered drinking straw movement.

In step three, stopping the covered drinking straw movement, the operator, after deciding how much of the covered drinking straw is placed into the invention for de-sheathing, stops pushing the drinking straw into the invention. After substantial completion of step three, the process 200 could proceed generally to step four, the cover drinking straw withdrawal.

In step four, the covered drinking straw withdrawal, the operator begins to withdraw the covered drinking straw. By withdrawing the covered drinking straw in the opposite and second direction, the de-sheathing device could exert sufficient force to securely grasp a section of the covering while allowing the drinking straw itself to be removed from the invention. In this manner, the de-sheathing device could cause prevent a portion of the covering from passing back through the de-sheathing orifice and, as a consequence, to tear away from a remainder of the cover that did not originally pass through the de-sheathing orifice and is removed along with the drinking straw from the apparatus. At the same time, when the de-sheathing device moves back towards its initial orientation, the de-sheathed portion of the cover is generally unable to pass though the de-sheathing device and is retained generally proximate to the underside. As step four is substantially completed, the process could proceed generally to step five, the use of drinking straw.

In step five, the use of the drinking straw, the partially de-sheathed covered drinking straw could have its exposed portion inserted into a drink or other appropriate receptacle. The operator could then remove and appropriately discard the remaining cover from the drinking straw allowing the drinking straw to be generally used for its intended purpose. As step five is substantially completed, the process could return to step one as required by the operator, as additional covered drinking straws need to be de-sheathed.

CONCLUSION

As generally described herein, the invention generally has an ability to de-sheath at least partially a covered drinking straw using a simple one-hand motion in a sanitary way utilizing a de-sheathing covered drinking straw apparatus that is substantially simple, easily manufactured, and may be employed in a wide variety of environments.

Although the description above contains many specifications, these should not be construed as limiting the scope of the invention but as merely providing illustrations of some of the presently preferred embodiments of this invention. Thus, the scope of the invention should be determined by the appended claims and their legal equivalents rather than by the examples given.

What is claimed is:

1. A method for operating a de-sheathing device for a covered drinking straw comprising the following steps but not necessarily in the following order:

(A) providing a body having a de-sheathing device that forms a de-sheathing orifice that has an initial first orifice diameter that expands to a larger second orifice diameter when at least a portion of a covered drinking straw is inserted through the de-sheathing orifice in one direction;

(B) inserting the portion of the covered drinking straw into the de-sheathing orifice in one direction; and (C) moving the covered drinking straw in a second direction;

whereby a force is applied by the de-sheathing device to the covered drinking straw thereby preventing a portion of the covering of the covered drinking straw from passing back through the de-sheathing orifice.

2. The method of claim 1 wherein the prevention of the portion of the covering of the covered drinking straw from passing back through the de-sheathing orifice occurs when the drinking straw and a remainder of the covering is withdrawn from the de-sheathing orifice in a second direction.

3. The method of claim 2 wherein the second direction is in the opposite direction of the first direction and when the drinking straw is fully withdrawn the straw no longer contacts the de-sheathing device.

4. The method of claim 1 wherein the de-sheathing device further comprises a plurality of fingers, with movable tips, radially disposed around a central axis in a plane of the de-sheathing orifice.

5. The method of claim 4 wherein the movable tips move out of the plane of the de-sheathing orifice when the portion of the covered drinking straw passes through the de-sheathing orifice.

6. The method of claim 5 wherein during step (C) the movable tips press the covering of the covered drinking straw and tear the covering while the drinking straw is being withdrawn from the de-sheathing orifice.

7. The method of claim 6 wherein the portion of the covering prevented from passing back through the de-sheathing device is retained within an interior as a remainder of the covering and the drinking straw is withdrawn from the designing sheathing orifice.

8. The method of claim 6 wherein the movable tips prevent the portion of the covering from passing back through the de-sheathing device.

9. The method of claim 4 wherein the movable tips are moveable from a first position forming the initial orifice diameter to a second position forming the larger second orifice diameter to allow passage of the covered drinking straw through the de-sheathing orifice.

10. The method of claim 4 wherein the force applied by the de-sheathing device to the covered drinking straw is applied by the movable tips to the covering of the covered drinking straw.

11. The method of claim 4 wherein withdrawal of the drinking straw from the de-sheathing orifice occurs when the drinking straw is moved in the second direction and when the drinking straw is fully withdrawn from the de-sheathing orifice the movable tips automatically move from a second position in which a distance between opposing movable tips forms the larger second orifice diameter of the de-sheathing orifice to a first position in which a distance between opposing tips forms the first orifice diameter of the de-sheathing orifice.

12. The method of claim 4 wherein the de-sheathing orifice adjusts from the larger second diameter to the initial first orifice diameter to retain the portion of the cover of the drinking straw inserted into the de-sheathing orifice from passing back through the de-sheathing orifice when the portion of the drinking straw inserted into the de-sheathing orifice is fully withdrawn from the de-sheathing orifice.

* * * * *